US008223099B2

(12) United States Patent
Nishimura et al.

(10) Patent No.: US 8,223,099 B2
(45) Date of Patent: Jul. 17, 2012

(54) DISPLAY AND CIRCUIT FOR DRIVING A DISPLAY

(75) Inventors: Kouichi Nishimura, Kanagawa (JP); Takashi Tahata, Kanagawa (JP); Kazuo Suzuki, Tokyo (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1263 days.

(21) Appl. No.: 11/785,755

(22) Filed: Apr. 19, 2007

(65) Prior Publication Data

US 2007/0247408 A1 Oct. 25, 2007

(30) Foreign Application Priority Data

Apr. 20, 2006 (JP) ..... 2006-116276

(51) Int. Cl.
*G09G 5/10* (2006.01)

(52) U.S. Cl. ..... 345/89; 345/98; 345/99; 345/100; 345/103; 345/204

(58) Field of Classification Search ..... 345/98–100, 345/103, 204
See application file for complete search history.

(56) References Cited

U.S. PATENT DOCUMENTS

| | | | | |
|---|---|---|---|---|
| 4,063,234 | A * | 12/1977 | Arn et al. | 345/73 |
| 5,598,180 | A | 1/1997 | Suzuki et al. | |
| 6,529,180 | B1 | 3/2003 | Ito et al. | |
| 7,030,869 | B2 * | 4/2006 | Morita | 345/208 |
| 7,176,910 | B2 | 2/2007 | Tsuchi | |
| 7,348,954 | B2 | 3/2008 | Miwa et al. | |
| 7,358,946 | B2 * | 4/2008 | Kokubun et al. | 345/87 |
| 7,362,296 | B2 | 4/2008 | Song et al. | |
| 7,439,944 | B2 * | 10/2008 | Huynh et al. | 345/82 |
| 7,499,025 | B2 | 3/2009 | Endo et al. | |
| 7,643,002 | B2 | 1/2010 | Kang et al. | |
| 2002/0039096 | A1 * | 4/2002 | Katsutani | 345/204 |
| 2005/0162370 | A1 | 7/2005 | Miyazaki | |
| 2006/0132419 | A1 * | 6/2006 | Morita | 345/98 |
| 2006/0227091 | A1 | 10/2006 | Nohtomi et al. | |
| 2006/0244710 | A1 * | 11/2006 | Iriguchi et al. | 345/100 |
| 2007/0247408 | A1 * | 10/2007 | Nishimura et al. | 345/89 |
| 2007/0290983 | A1 | 12/2007 | Kim et al. | |

FOREIGN PATENT DOCUMENTS

JP 5-8592 U 2/1993

(Continued)

OTHER PUBLICATIONS

Office Action dated Apr. 27, 2010 for U.S. Appl. No. 11/785,756.

(Continued)

*Primary Examiner* — Alexander S Beck
*Assistant Examiner* — Jeffrey Steinberg
(74) *Attorney, Agent, or Firm* — McGinn IP Law Group, PLLC

(57) ABSTRACT

A display driver for evenly display the screen driven by a plurality of driver circuits is provided. The display apparatus includes a display panel driven by data lines and driver units. Each of the data lines is driven by the corresponding driver unit. Each of the driver units has a resistance division unit for generating grayscale voltages, an operational amplifier unit for supplying voltages to the terminals of the resistance division unit in response to a bias control signal. The corresponding terminals of the resistance division unit of the plurality of driver circuits are commonly connected. The bias control signal is supplied when each of the driver circuit drives the corresponding data line.

21 Claims, 7 Drawing Sheets

FOREIGN PATENT DOCUMENTS

| | | | |
|---|---|---|---|
| JP | 5-119744 | | 5/1993 |
| JP | 6-348235 | | 12/1994 |
| JP | 10-142582 | | 5/1998 |
| JP | 11-167095 | A | 6/1999 |
| JP | 2001-504244 | A | 3/2001 |
| JP | 2001-175226 | A | 6/2001 |
| JP | 2002-236473 | A | 8/2002 |
| JP | 2003-228348 | A | 8/2003 |
| JP | 2003-302951 | | 10/2003 |
| JP | 2003-316333 | A | 11/2003 |
| JP | 2004-127077 | A | 4/2004 |
| JP | 2005-070338 | A | 3/2005 |
| JP | 2005-345808 | A | 12/2005 |
| JP | 2006-39205 | A | 2/2006 |

OTHER PUBLICATIONS

Office Action in U.S. Appl. No. 11/785,756 dated Aug. 24, 2010.
Notification of Reasons for Refusal dated Nov. 8, 2011 (with an English translation).
Notice of Reasons for Refusal dated Nov. 8, 2011 (with an English translation).

* cited by examiner

DISPLAY AND CIRCUIT FOR DRIVING A DISPLAY

BACKGROUND OF THE INVENTION

1. Field of the Invention

The present invention relates to the control of a liquid crystal display.

2. Description of the Related Art

The liquid crystal display, whose electric power consumption is small, is installed in various electronic equipments. In recent years, the cellular telephone, the PDA (Personal Digital Assistant) and a large screen television and the like have been penetrated in the market, and the color TFT-LCD (Thin Film Transistor Liquid Crystal Display) has been used as the display of those devices. The liquid crystal display includes an LCD panel and a drive unit. Typically, the LCD panel of the large screen liquid crystal display is driven at a block unit. Block units included in a LCD panel are driven by the respective driver Large Scale Integrated Circuits.

Also, a color liquid crystal display can display grayscale images. The color liquid crystal display presently supplied on the market can represent the grayscale tones of 6 bits (about 260,000 colors). Moreover, products that can cope with the grayscale representation of 8 bits (about 16,700,000 colors) as well as 10 bits (about 1,000,000,000 colors) are being developed.

Recently, a COG (Chip on Glass) technology is used to integrate an LCD panel and an LCD driver into a single unit module. Since an LCD panel and an LCD driver are made into a module, the volume of the driver unit is reduced, thereby the cost of the liquid crystal display is reduced.

In such a liquid crystal display, the LCD driver has a grayscale power source circuit used to determine a gamma characteristic. The grayscale power source circuit generates a grayscale voltage, in response to the property of the LCD panel. The conventional liquid crystal display has the IC constituting the LCD driver, and other IC for the grayscale power source. The grayscale power source IC is used to adjust the gamma characteristic of the LCD driver contained in the liquid crystal display. Also, in association with the recent advancement of a semiconductor technique, an LCD driver IC including the grayscale power source circuit is developed, which enables the cost reduction of the liquid crystal display. In such a LCD driver, an operational amplifier of the grayscale power source circuit is constituted by CMOS.

In a typical MOS transistor, gm (mutual conductance) that determines a driving property is smaller than the gm of the bipolar transistor. Thus, in the grayscale power source circuit composed of MOS transistors, it is sometimes difficult to ensure a margin of the driving performance as compared with the grayscale power source circuit composed of bipolar transistors. Hence, a technique for generating a suitable grayscale voltage by devising the circuit structure is desired (for example, refer to Japanese Laid Open Patent Application JP-A-Heisei, 10-142582 and JP-A-Heisei, 6-348235).

FIG. 1 is a block diagram showing the configuration of the liquid crystal display noted in Japanese Laid Open Patent Application (JP-A-Heisei, 10-142582). Hereafter, the case where a displaying signal processed by a data driver is the digital signal of 6-bit is explained. With reference to FIG. 1, a conventional LCD data driver 111 is provided with: a data register 101 for receiving displaying signals RBG (Red, Green and Blue) from outside; a latch circuit 102 for latching a 6-bit digital signal in synchronization with a strobe signal ST; a D/A converter 103 composed of digital/analog converters of parallel N stages; a grayscale voltage generation circuit 104 having the gamma conversion characteristic adjusted to be matching with the property of a liquid crystal; and an output amplification unit 105 that has N voltage followers (105-1 to 105-n) for buffering voltages from the D/A converter 103.

The LCD panel 112 includes pixels (108-1 to 108-n) installed at the intersections between data lines and scanning lines. Each of the plurality of pixels (108-1 to 108-n) is composed of thin film transistor (TFT) and pixel capacitor 107.

In each of the thin film transistors (106-1 to 106-n) contained in the pixels, the gate is connected to the scanning line and the source is connected to the data line. Also, in each of the pixel capacitors (107-1 to 107-n) contained in the pixels, one end is connected to the respective drain of the thin film transistors (106-1 to 106-n), and the other end is connected to the COM terminal. FIG. 1 diagrammatically shows the configuration of the pixels corresponding to one column for supporting the easy understanding of the structure of the LCD panel 112. The N thin film transistors (TFTs) are formed correspondingly to a plurality of columns (M columns). An LCD gate driver (not shown) is connected to each gate line of the LCD panel 112, and sequentially drives the gates of the respective thin film transistors.

The D/A converter 103 executes a D/A conversion on the 6-bit digital displaying signal of the latch circuit 102 and sends to the N voltage followers (105-1 to 105-n) contained in the output amplification unit 105. The data outputted from the output amplification unit 105 is applied via the thin film transistors (106-1 to 106-n) to liquid crystal elements serving as the pixel capacitors (107-1 to 107-n).

The grayscale voltage generation circuit 104 generates a reference grayscale voltage and sends it to the D/A converter 103. In the D/A converter 103, a decoder constituted by a ROM switch or the like (not shown) selects the reference grayscale voltage.

The configuration of the conventional grayscale voltage generation circuit 104 will be described below. FIG. 2 is a circuit diagram showing the configuration of the grayscale voltage generation circuit 104 noted in Japanese Laid Open Patent Application (JP-A-Heisei, 10-142582). The grayscale voltage generation circuit 104 has a resistor ladder circuit. This is designed to be driven by a voltage follower, in order to drop the impedance at each reference voltage point and execute minor adjustment of the reference voltage.

With reference to FIG. 2, the conventional grayscale voltage generation circuit 104 is provided with an external ladder resistor circuit 201, a buffer amplifier 202, a built-in ladder resistor circuit 203 and a constant voltage generating circuit 204. As shown in FIG. 2, the LCD driver built-in resistor ladder circuit 203 includes built-in resistors ($\mathbf{203}_1$ to $\mathbf{203}_{n-1}$). Also, the external resistor ladder circuit 201 includes external ladder resistors ($\mathbf{201}_0$ to $\mathbf{201}_{n-1}$) Moreover, the buffer amplifier 202 includes operational amplifiers ($\mathbf{202}_1$ to $\mathbf{202}_n$).

Each of the operational amplifiers is constituted of a voltage follower configured to feed the output signal back to the inverting input terminal. The external ladder resistors constituting the external resistor ladder circuit 201 are constituted of variable resistors and adjust the voltages applied to the operational amplifiers ($\mathbf{202}_1$ to $\mathbf{202}_n$) By such a configuration, the conventional grayscale voltage generation circuit 104 generates the adjustment voltage corresponding to the property of the liquid crystal panel. The voltage supplied to the external ladder resistor circuit 201 is a reference supply voltage Vr generated by the ground potential GND and the constant voltage generating circuit 204. The reference supply voltage Vr is given by a stable external constant voltage generating circuit, for example, a band gap reference.

Here, the resistances of the built-in resistors ($\mathbf{203}_1$ to $\mathbf{203}_{n-1}$) are assumed as follows.

First Built-in Resistor $\mathbf{203}_1$=$R_1$ [Ω]
Second Built-in Resistor $\mathbf{203}_2$=$R_2$ [Ω]- - -
(n−2)-th Built-in Resistor $\mathbf{203}_{n-2}$=$R_{n-2}$ [Ω]
(n−1)-th Built-in Resistor $\mathbf{203}_{n-1}$=$R_{n-1}$ [Ω]

The resistances of the external ladder resistors ($\mathbf{201}_0$ to $\mathbf{201}_{n-1}$) are assumed as follows.

First External Ladder Resistor $\mathbf{201}_0$=$R'_0$ [Ω]
Second External Ladder Resistor $\mathbf{201}_1$=$R'_1$ [Ω]- - -
(n−1)-th External Ladder Resistor $\mathbf{201}_{n-2}$=$R'_{n-2}$ [ΩQ]
n-th External Ladder Resistor $\mathbf{201}_{n-1}$=$R'_{n-1}$ [Ω]

Then, in the liquid crystal grayscale voltage generation circuit shown in FIG. 2, the grayscale voltages $V_n$, $V_{n-1}$, $V_{n-2}$, - - - , $V_2$ and $V_1$ are determined by the resistances $R'_0$, $R'_1$, $R'_2$, - - - , $R'_{n-2}$ and $R'_{n-1}$ of the external ladder resistors ($\mathbf{201}_0$ to $\mathbf{201}_{n-1}$) constituting the external ladder resistor circuit 201.

That is, each of the voltages outputted from the built-in ladder resistor circuit 203 is represented as follows.

$$V=V_r$$

$$V_{n-1}=V_r\{(R'_{n-2}+R'_{n-3}+ - - - R'_0)/(R'_{n-1}+R'_{n-2}+R'_{n-3}+ - - - +R'_0)\}$$

$$V_1=V_r\{R'_0/(R'_{n-1}+R'_{n-2}+R'_{n-3}+ - - - R'_0)\}$$

Here, if the ratio between the resistances ($R_1$, $R_2$, - - - , $R_{n-2}$ and $R_{n-1}$) of the built-in resistors ($\mathbf{203}_1$ to $\mathbf{203}_{n-1}$) to determine the grayscale voltage therein and the ratio between the resistances ($R'_1$, $R'_2$, - - - , $R'_{n-2}$ and $R'_{n-1}$) of the external ladder resistors ($\mathbf{201}_0$ to $\mathbf{201}_{n-1}$) are equal to each other, the output currents of the operational amplifiers ($\mathbf{202}_1$ to $\mathbf{202}_n$) become zero.

However, the output current $I_n$ of the n-th operational amplifier $\mathbf{202}_n$ (the operational amplifier arranged in n-th position from the GND side) is given by the following equation in the discharging direction.

$$I_n = (V_n - V_1)/(R_1 + R_2 + \ldots + R_{n-1}) = I_0 \quad (1)$$

Also, the output current $I_1$ of the first operational amplifier $\mathbf{202}_1$ (the operational amplifier arranged in the first position from the GND side) is given by the following equation in the absorbing direction.

$$I_1 = (V_n - V_1)/(R_1 + R_2 + \ldots + R_{n-1}) = I_0 \quad (2)$$

As mentioned above, the respective amplifiers in the n-th operational amplifier $\mathbf{202}_n$ and the first operational amplifier $\mathbf{202}_1$ are provided with the output stages that can drive those output currents.

FIG. 3 is a block diagram showing the configuration of the LCD data driver having a plurality of driver circuits. In the following explanation, for the easy understanding of the conventional technique, the LCD data driver where in the two driver circuits, the data line of the LCD panel 112 is driven is exemplified. In this case, the two driver circuits 205 in the conventional data driver 111 are similarly configured. Also, to the function blocks which are same with or similar to the function blocks of the data driver 111 in FIG. 1, the symbols same with those of FIG. 1 are assigned, and the redundant explanation will be avoided. The following explanations can be equally applied to any one of the driver circuits 205.

With reference to FIG. 3, the driver circuit 205 is provided with the data register 101, the latch circuit 102, the D/A converter 103, the output amplification unit 105 and a grayscale voltage output circuit 206. The grayscale voltage output circuit 206 is composed of: a first grayscale resistor group for generating a positive grayscale voltage; a second grayscale resistor group for generating a negative grayscale voltage; a first operational amplifier 301; a second operational amplifier 302; a third operational amplifier 303; and a fourth operational amplifier 304. As shown in FIG. 3, the first operational amplifier 301 is constituted by an operational amplifier, the terminals of which are connected as the voltage follower, and supplies the highest potential in the first grayscale resistor group. The second operational amplifier 302 is constituted by an operational amplifier, the terminals of which are connected as the voltage follower, and supplies the lowest potential in the first grayscale resistor group. The third operational amplifier 303 is constituted by an operational amplifier, the terminals of which are connected as the voltage follower, and supplies the highest potential in the second resistor group. The fourth operational amplifier 304 is constituted by operational amplifier, the terminals of which are connected as the voltage follower, and supplies the lowest potential in the second resistor group.

With reference to FIG. 3, in the conventional driver circuit 205, a first power source 207 (VH+) is connected to the non-inverting input terminal of the first operational amplifier 301, a second power source 208 (VL+) is connected to the non-inverting input terminal of the second operational amplifier 302, a third power source 209 (VH−) is connected to the non-inverting input terminal of the third operational amplifier 303, and a fourth power source 210 (VL−) is connected to the non-inverting input terminal of the fourth operational amplifier 304. As shown in FIG. 3, in the two driver circuits 205, the non-inverting input terminals of the first operational amplifier (voltage follower) 31 to fourth operational amplifier 304 are commonly connected. The first to fourth power sources 207 to 210 require the buffer amplifiers, because they are usually constructed by resistance division so that their impedances are high. The first to fourth operational amplifiers 301 to 304 act as the buffer amplifiers. For example, in the LCD panel 112 of a normally white type, the high potential of the positive grayscale corresponds to the black level, and the low potential corresponds to the white level. Moreover, the low potential of the negative grayscale corresponds to the black level, and the high potential corresponds to the white level. Thus, in the data driver 111, the voltages of the first to fourth power sources 207 to 210 are set so as to obtain the foregoing grayscale.

In Japanese Laid Open Patent Application (JP-A-Heisei, 5-119744), a liquid crystal display driven by a plurality of drivers is described.

SUMMARY OF THE INVENTION

As mentioned above, the widely used liquid crystal display is driven by a plurality of LCD drivers for displaying an image on the LCD panel at a block (the displaying region of the LCD screen) unit. The LCD driver, which is constituted by using the COG (Chip on Glass) technique, typically has a large wiring resistance. The voltage drop caused by the wiring resistance results in the drop in a current flowing through a gamma resistance element (a resistor element to determine the gamma characteristic) contained in each LCD driver. The display to which the COG technique is applied has the voltage follower for preventing the current drop.

The voltage follower (operational amplifier) contained in the grayscale power source circuit has a differential amplifier at an input stage. Since a difference is occurred between the thresholds of the MOS transistors constituting the differential amplifier, an offset voltage is generated in the operational amplifier. There is a case that the factor, such as a piece-to-piece variation on manufacture and the like, causes a difference to be generated even in the offset voltage for each driver circuit.

In this case, the difference between the offset voltages of the operational amplifiers (voltage follower) constituting the grayscale power source circuit may possibly cause the grayscale to be different between the respective LCD drivers. Thus, the grayscale is different for each displaying region corresponding to the plurality of LCD drivers, and there is a case of an occurrence of a block irregularity (the phenomenon where the grayscale level is different for each displaying region of the LCD panel).

The human's eye is said to recognize the difference of 10 mV with respect to the voltage of the liquid crystal, as the different grayscale level. The grayscale voltage is determined by the resistance division built in each LCD driver. When this resistance division ratio is different for each driver circuit, the grayscale property is different for each driver circuit. When the grayscale property of the first LCD driver and the grayscale property of the second LCD driver are different, if the two drivers are adjacently arranged, the boundary discontinuity of them is recognized by the human's eye.

Also, in the LCD driver having the plurality of driver circuits as mentioned above, the resistance variation in the respective driver circuit brings about the variation in the resistance precision. As a result, there is a case where the grayscale property is different between the respective drivers. This variation in the resistance precision may be a factor of the block irregularity.

It is therefore an object of the present invention to provide a displaying technique which, in a case where a data line of a display is driven by a plurality of driver circuits contained in each different displaying region, appropriately represents a grayscale for each displaying region.

According to the present invention, in the case where the data line of the display is driven by the plurality of driver circuits contained in each different displaying region, the grayscale for displaying regions constructing a screen can be appropriately represented.

DESCRIPTION OF THE PREFERRED EMBODIMENTS

[First Embodiment]

Figure 1:
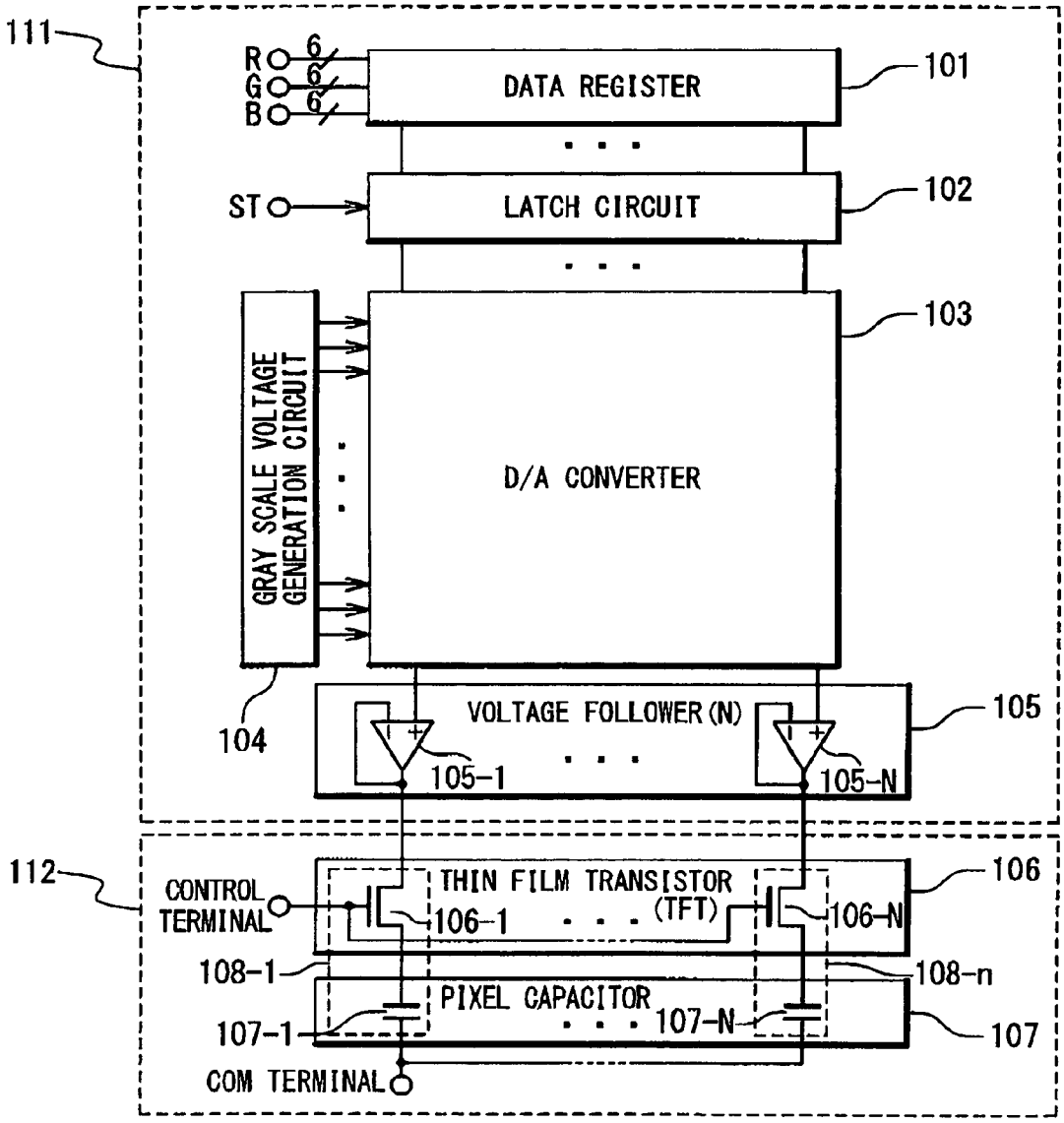
Fig. 1 PRIOR ART
FIG. 1 is a block diagram showing a configuration of a conventional liquid crystal display.
Figure 2:
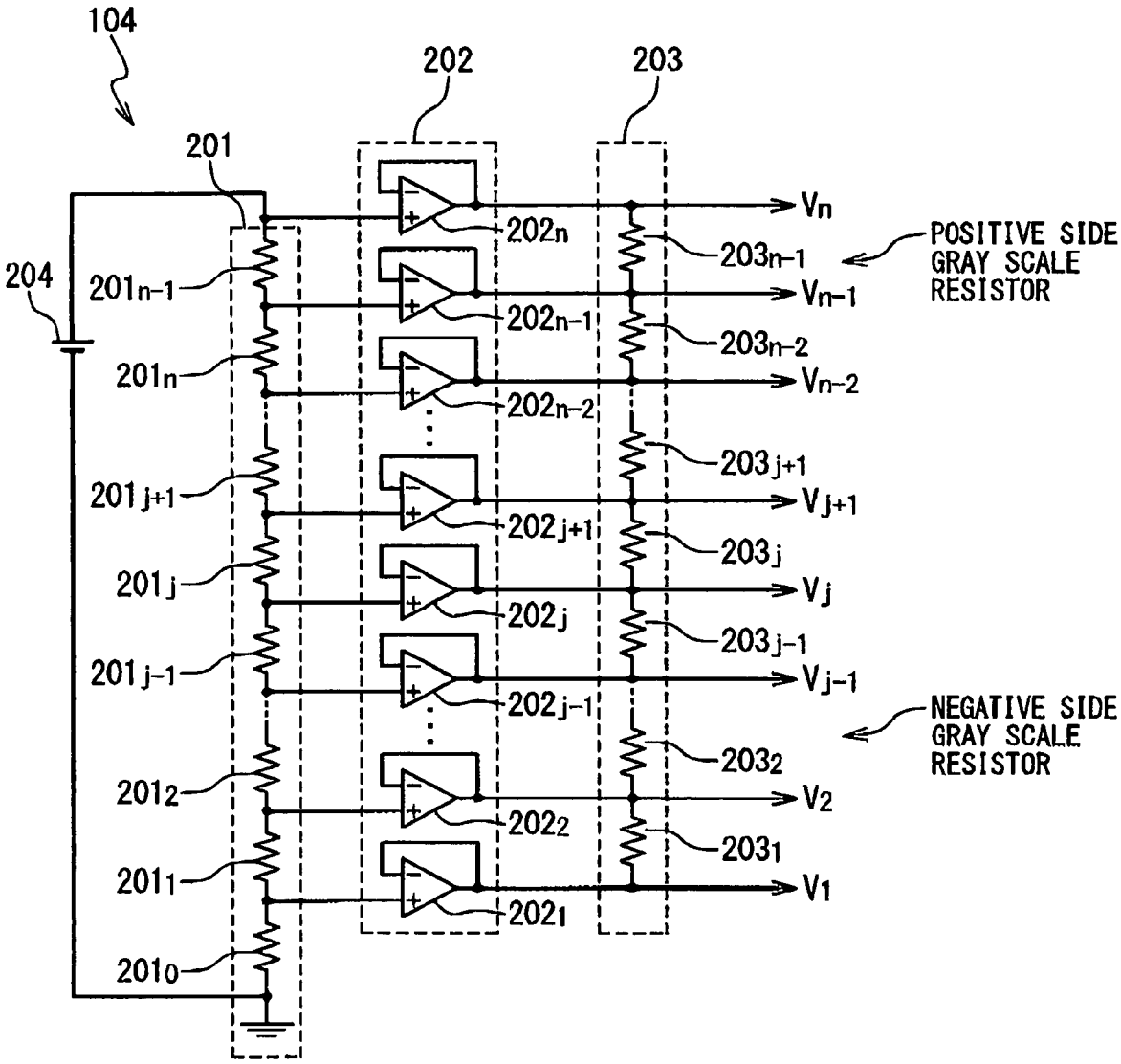
Fig. 2 PRIOR ART
FIG. 2 is a circuit diagram showing a configuration of a conventional grayscale voltage generation circuit.
Figure 3:
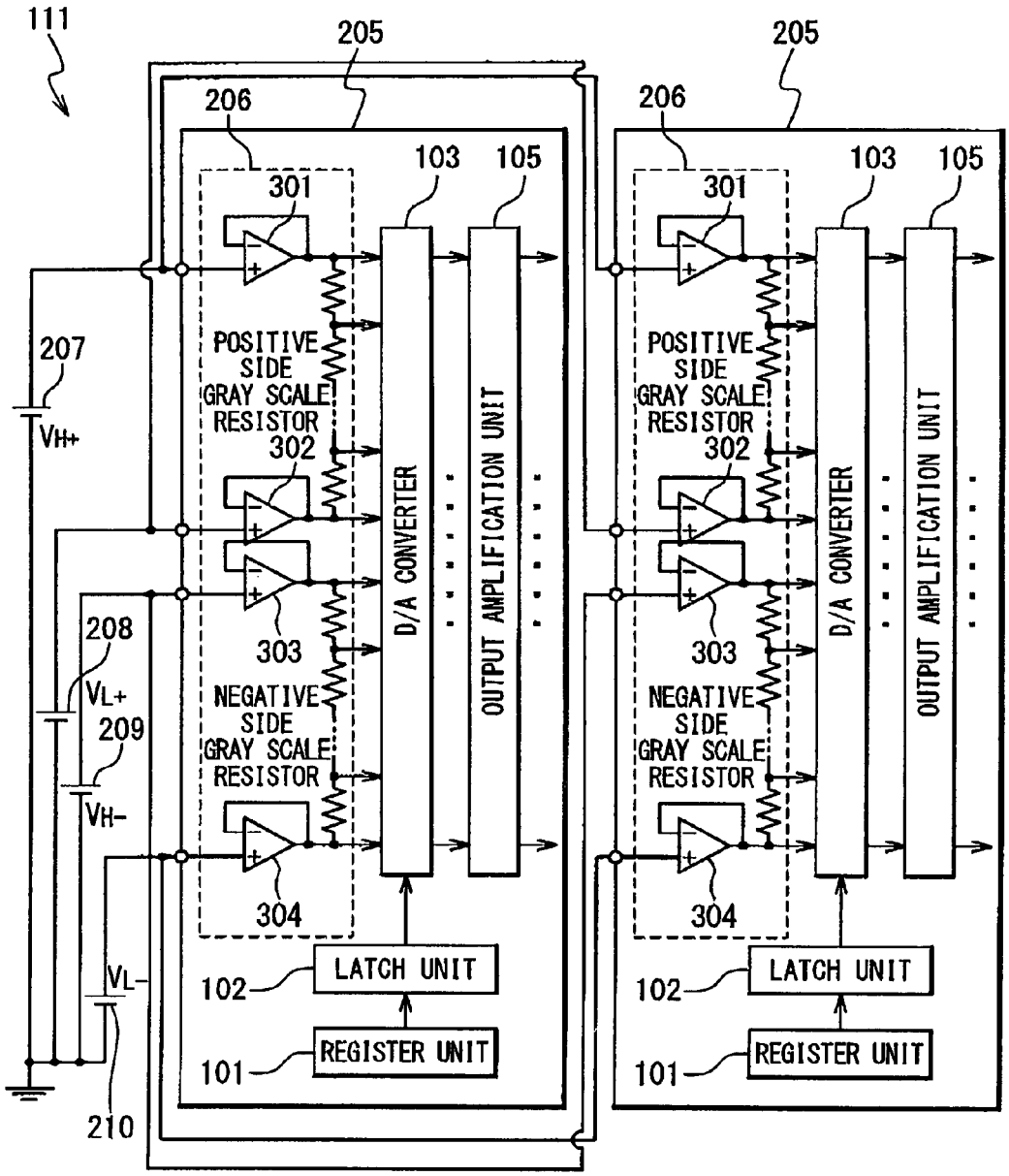
Fig. 3 PRIOR ART
FIG. 3 is a block diagram showing a conventional configuration of an LCD data driver that has the plurality of driver circuits.
Figure 4:
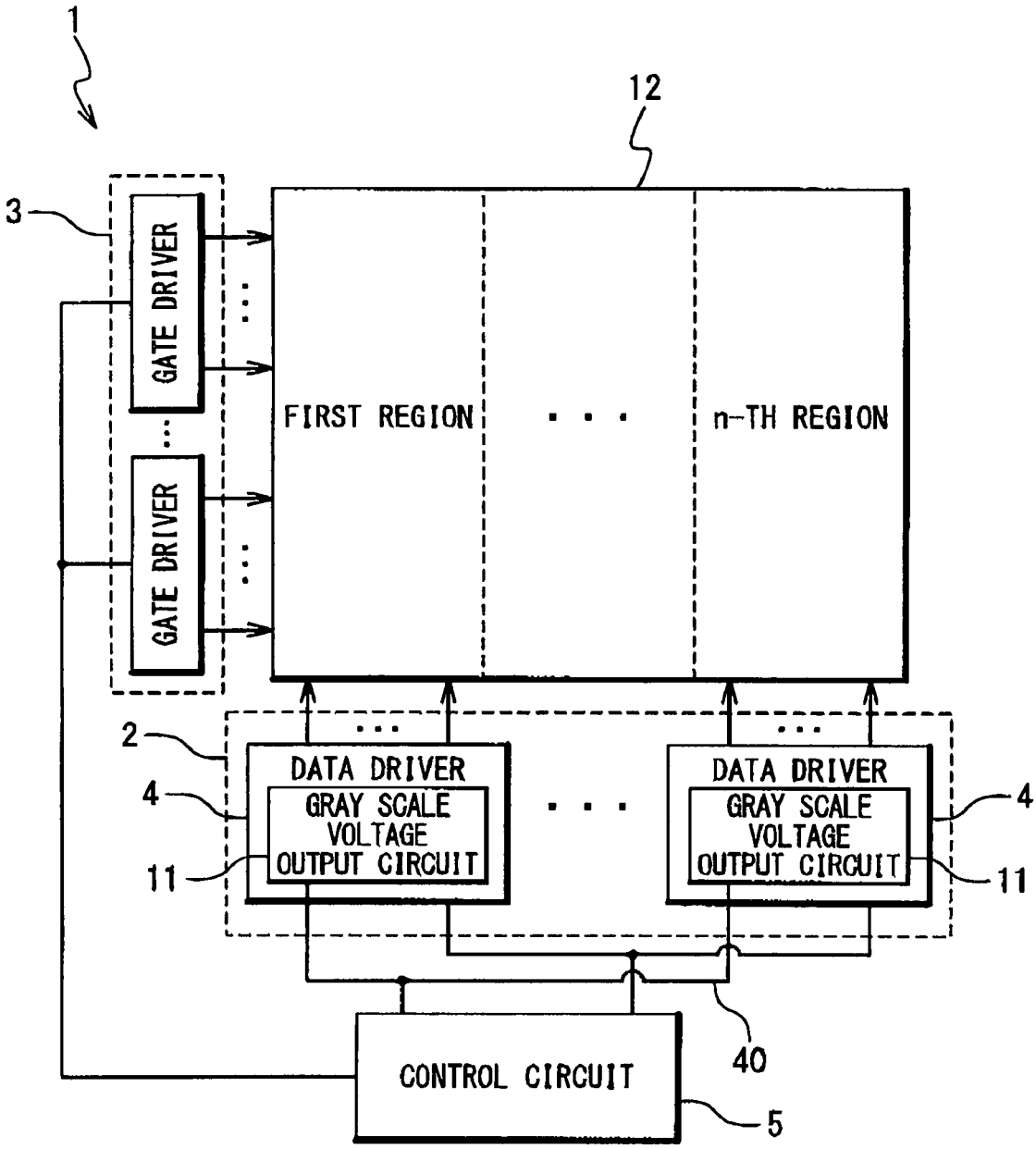
FIG. 4 is a block diagram showing a configuration of a display 1 in an embodiment of the present invention.

The embodiment of the present invention will be described below with reference to the drawings. In the following explanation, the displaying signal processed by the data driver circuit 4 is supposed to be the 6-bit digital displaying signal. FIG. 4 is a block diagram exemplifying the configuration of a display 1 in this embodiment. With reference to FIG. 4, the display 1 in this embodiment is provided with a displaying panel 12, a data driver unit 2, a gate driver unit 3 and a control circuit 5. The displaying panel 12 has: data bus lines (hereafter, referred to as data lines); and gate bus lines (hereafter, referred to as gate lines) arranged orthogonally to the data lines. The displaying panel 12 includes pixels installed at the intersections between the data lines and the gate lines. Each of the pixels is constituted by a thin film transistor (TFT) and a pixel capacitor.

The gate of the thin film transistor contained in each of the pixels is connected to the gate line. Also, the source of the thin film transistor is connected to the data line. One end of the pixel capacitor in each pixel is connected to the drain of the thin film transistor, and the other end thereof is connected to the COM terminal.

The data driver unit 2 performs a D/A conversion on a digital image signal of a plurality of bits, generates an analog image signal and outputs the analog image signal to the data line.

The gate driver unit 3 is a circuit for outputting a gate pulse voltage, and drives the gate line correspondingly to a drive method, such as a line sequence method, and sequentially drives the gates of the thin film transistors.

The control circuit 5 is a controller for controlling the display, in response to a horizontally synchronous signal, a vertically synchronous signal, a data transfer clock. The control circuit 5 outputs control signals to the drivers (the data driver unit 2 and the gate driver unit 3).

As shown in FIG. 4, the data driver unit 2 is composed of the plurality of data driver circuits 4. Each of the data driver circuits 4 has a grayscale voltage output circuit 11. Also, the gate driver unit 3 includes a plurality of gate driver circuits. The plurality of data driver circuits 4 are connected to the gate lines connected to the corresponding displaying regions (a first region to an n-th region). As mentioned above, in the case of the occurrence of the block irregularity, a grayscale difference is generated at the border (indicated by alternate long and short dash line in FIG. 4) of the displaying region. In this embodiment, the occurrence of the block irregularity is suppressed by the configurations and operations which will be described below.

Figure 5:
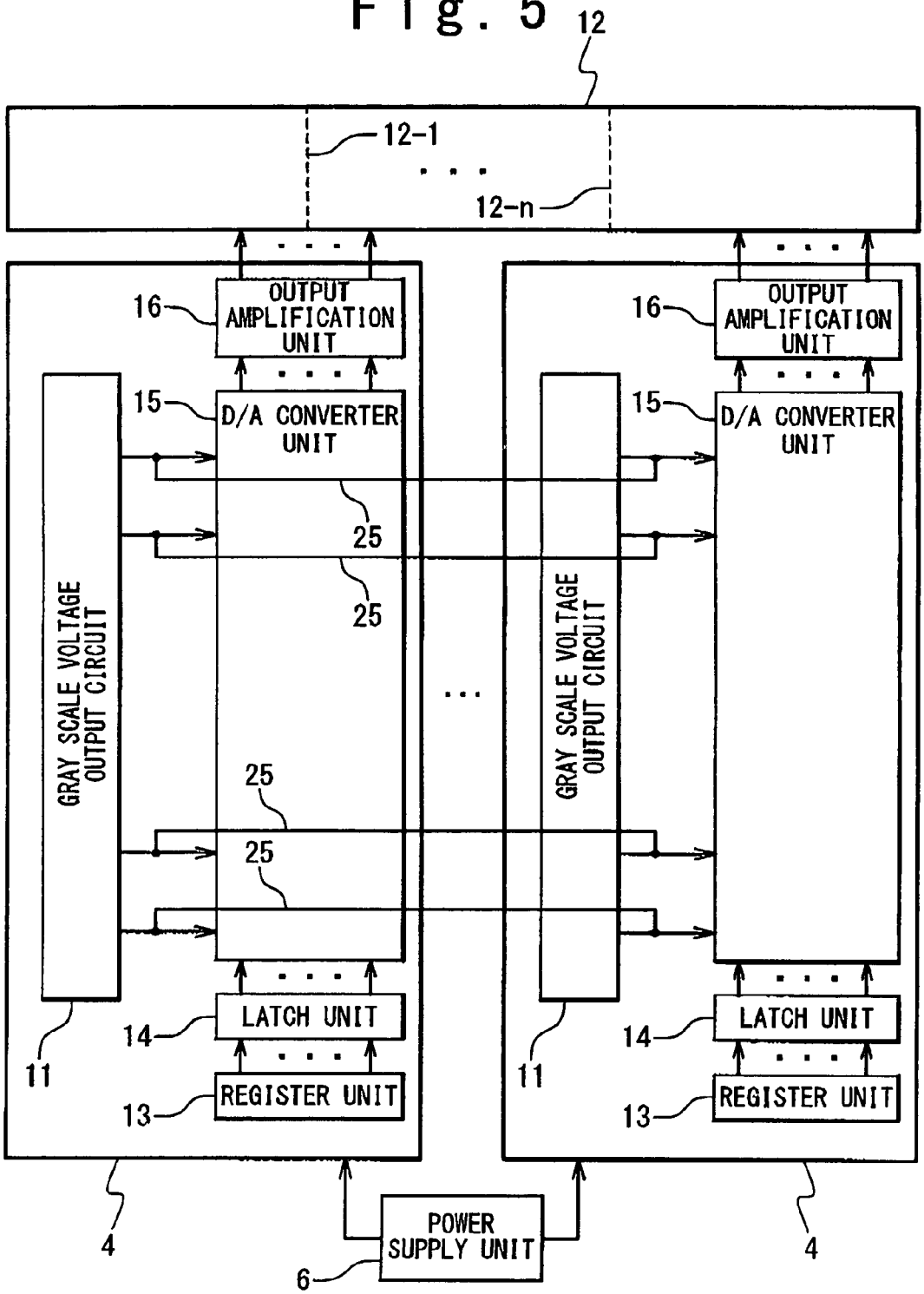
FIG. 5 is a block diagram showing a configuration of a data driver unit 2.

FIG. 5 is a block diagram showing the configuration of the data driver unit 2. In this embodiment, the plurality of data driver circuits 4 contained in the data driver unit 2 are configured similarly to each other. With reference to FIG. 5, the data driver circuit 4 in this embodiment includes: a register 13 for receiving displaying signals R, G and B from outside; a latching unit 14 for latching a 6-bit digital signal in synchronization with a strobe signal ST; a D/A converter 15 constituted by digital/analog converters of parallel N stages; the grayscale voltage output circuit 11 having the gamma characteristic based on the property of the liquid crystal; and an output amplification unit 16 for buffering a voltage from the D/A converter 15. Also, as shown in FIG. 5, the display 1 in this embodiment has a power source supplier 6. The plurality of data driver circuits 4 generate the grayscale voltage in accordance with a reference voltages supplied from the power source supplier 6. Moreover, as shown in FIG. 5, the grayscale voltage output circuits 11 in the plurality of data driver circuits 4 have output ends for each stage of the grayscale. In each data driver circuit 4, the output ends of the stages of the same grayscale are connected to each other through connection lines 25.

Figure 6:
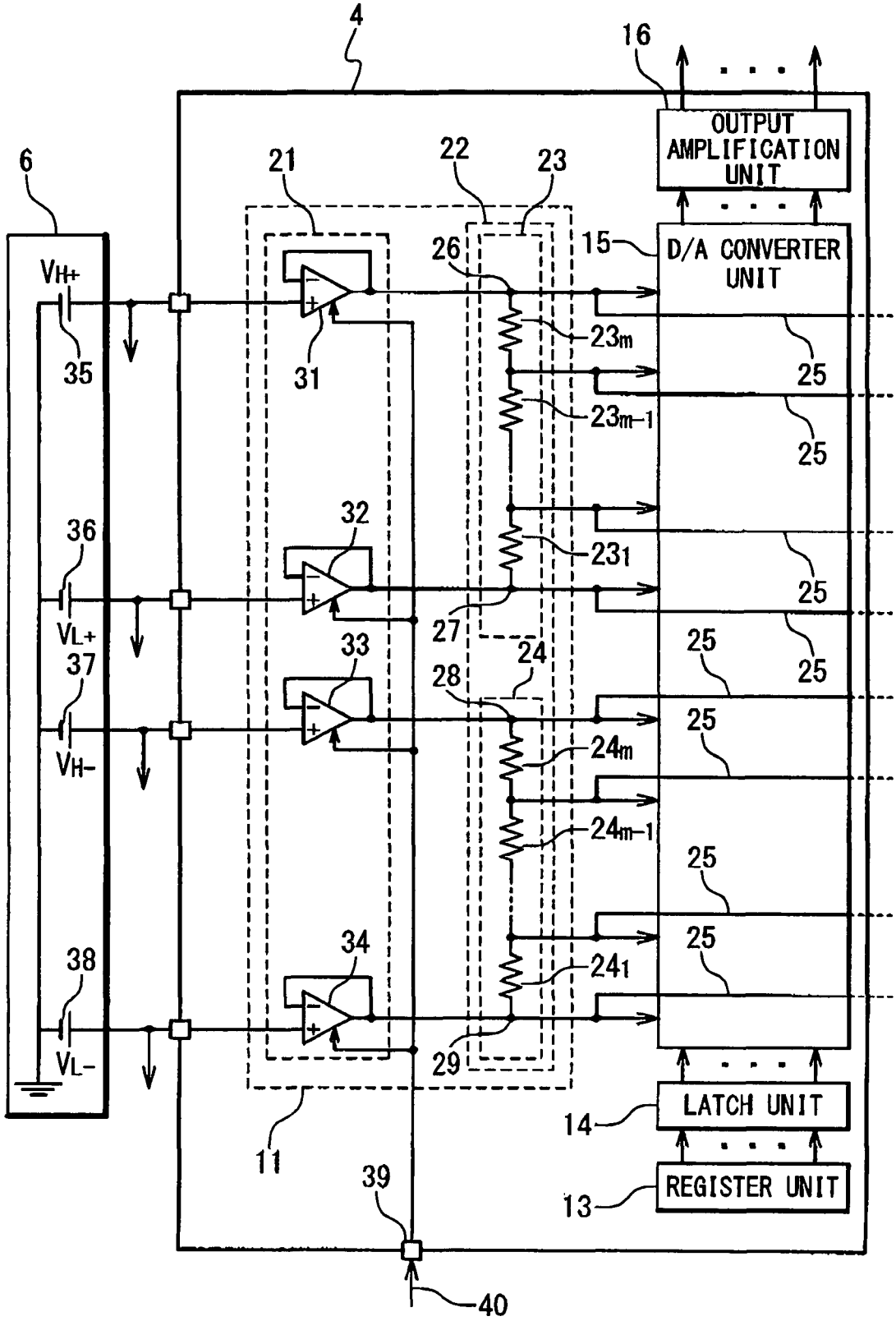
FIG. 6 is a circuit diagram exemplifying a configuration of a grayscale voltage output circuit 11.

FIG. 6 is a circuit diagram exemplifying the configuration of the grayscale voltage output circuit 11 in the data driver circuit 4. With reference to FIG. 6, the grayscale voltage output circuit 11 includes a buffer amplifier 21 and a resistance divider 22. The resistance divider 22 has a positive grayscale voltage generator 23 and a negative grayscale voltage generator 24.

As shown in FIG. 6, the buffer amplifier 21 includes a plurality of operational amplifiers (31 to 34). The power source supplier 6 includes a first power source 35, a second power source 36, a third power source 37 and a fourth power source 38. The first to fourth power sources 35 to 38 are formed by the resistance division and require buffer amplifiers because they are high in impedance. First to fourth voltage followers 31 to 34 contained in the buffer amplifier 21 act as the buffer amplifiers. Each of the first to fourth voltage followers 31 to 34 is the voltage follower in which the output is fed back to the inverting input terminal. The voltages outputted by the power source supplier 6 are supplied to their non-inverting input terminals.

With reference to FIG. 6, the positive grayscale voltage generator 23 includes a plurality of resistors ($\mathbf{23}_1$ to $\mathbf{23}_n$). Also, the negative grayscale voltage generator 24 includes a plurality of resistors ($\mathbf{24}_1$ to $\mathbf{24}_n$) As shown in FIG. 6, the output end of the first voltage follower 31 is connected to the first node 26. Also, the output end of the second voltage follower 32 is connected to the second node 27. Also, the output end of the third voltage follower 33 is connected to the third node 28. Moreover, the output end of the fourth voltage follower 34 is connected to the fourth node 29.

The positive grayscale voltage generator 23 generates positive grayscale voltages in accordance with the voltages outputted by the first voltage follower 31 and the second voltage follower 32. Similarly, the negative grayscale voltage generator 24 generates negative grayscale voltages in accordance with the voltages outputted by the third voltage follower 33 and the fourth voltage follower 34. As shown in FIG. 6, a buffer amplifier output control signal 40 is sent through a control signal supply terminal 39 to each of the first to fourth voltage followers 31 to 34. The first to fourth voltage followers 31 to 34 set the output at high impedance, in response to the buffer amplifier output control signal 40.

The grayscale voltage outputted from the resistance divider 22 is supplied to the D/A converter 15. As mentioned above, the output of the resistance divider 22 is connected through the connection line 25 to the output end of the resistance divider 22 contained in the other data driver circuit 4.

As mentioned above, each of the plurality of data driver circuits 4 contained in the data driver unit 2 is connected through the connection lines 25. Here, the plurality of operational amplifiers (31 to 34) constituting the buffer amplifier 21 have the function for setting the output end at high impedance, in response to the buffer amplifier output control signal 40 sent through the control signal supply terminal 39. In other words, in this embodiment, the buffer amplifier output control signal 40 is assumed to have the values of a High level and a Low level. The plurality of operational amplifiers (31 to 34) are assumed to have the circuit configuration that can control the impedance of the output end, in response to the High level (or Low level) indicated by the buffer amplifier output control signal 40.

In this embodiment, the buffer amplifier output control signal 40 is constituted by a bias circuit (not shown) contained in the control circuit 5. The control circuit 5 controls the bias circuit so that the plurality of operational amplifiers (31 to 34) included in a currently specified driver circuit can be usually operated, through the control signal supply terminal 39.

At this time, the control circuit 5 sends an inversion buffer amplifier output control signal 40, in which the buffer amplifier output control signal 40 is inverted, to the control signal supply terminals 39 of the other driver circuits. The plurality of operational amplifiers (31 to 34) contained in the other driver circuits set the output impedance at the high impedance, in response to the inversion buffer amplifier output control signal 40.

In the plurality of operational amplifiers contained in the respective driver circuits, the outputs are connected through the connection lines 25 to each other. In this case, in the operational amplifiers of the other driver circuits, the bias current is cut off by the buffer amplifier output control signal 40 sent through the control signal supply terminal 39, and as a result, the output impedance is set at the high impedance. The positive grayscale voltage generator 23 and negative grayscale voltage generator 24 which are built in the other driver circuit are driven simultaneously with the positive grayscale voltage generator 23 and the negative grayscale voltage generator 24, which are built in the driver which is currently driven, by the operational amplifier built in the driven driver circuit.

In other words, the built-in grayscale power source operational amplifier in the only one driver circuit among a plurality of LCD driver circuits is made active and set at the usually operable state. This only one driver is controlled by the buffer amplifier output control signal 40 sent through the control signal supply terminal 39. On the other hand, the grayscale power source operational amplifiers that are built in the other LCD driver circuits are made inactive, and its output is set at the high impedance. This is also executed by the buffer amplifier output control signal 40 (the inversion buffer amplifier output control signal 40) sent through the control signal supply terminal 39. With this operation, even if the output terminals of the operational amplifiers are electrically shorted on the circuit, the abnormal current does not flow, and the block irregularity can be suppressed.

In short, in conventional driver circuits, the outputs of the operational amplifiers were low in impedance, and the offset voltages were generally different, so that the output terminals of them can not be connected to each other. If the outputs were connected to each other, the offset voltages of the operational amplifiers would cause the excessive current to flow, which disabled the circuits to be normally operated.

On the contrary, the present invention is designed such that the outputs of the other operational amplifiers are set at the high impedance state, and the control terminals of the bias is installed so as not to bring about any problem even if the outputs are electrically shorted, and the outputs of the operational amplifiers of a driver is set at the high impedance state. Consequently, the outputs of the operational amplifiers can be electrically shorted. Accordingly, the grayscale voltages can be made common between the plurality of LCD drivers. As a result, the effect that the displaying trouble referred to as the block irregularity can be suppressed.

[Second Embodiment]

Figure 7:
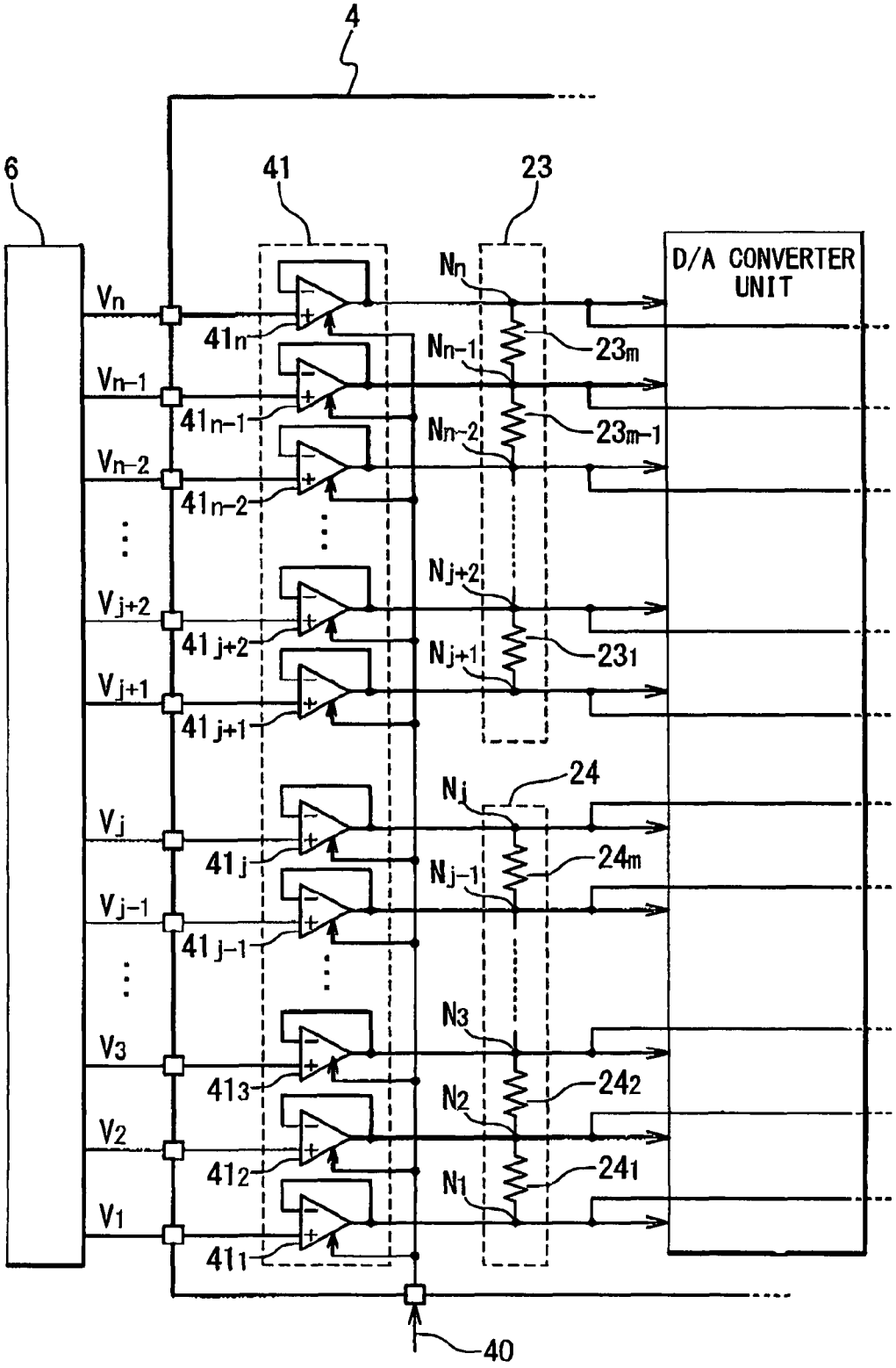
FIG. 7 is a circuit diagram exemplifying a configuration of a data driver circuit 4 in a second embodiment.

The second embodiment of the present invention will be described below with reference to the drawings. FIG. 7 is a circuit diagram exemplifying the configuration of the data driver circuit 4 in the second embodiment. In FIG. 7, the member to which the same symbol as the first embodiment has the configuration and operation similar to those of the first embodiment.

With reference to FIG. 7, the data driver circuit 4 in the second embodiment has a buffer amplifier 41. The buffer amplifier 41 has the operational amplifiers whose number is equal to the number of the nodes where the voltages are divided in the positive grayscale voltage generator 23 and the negative grayscale voltage generator 24. As shown in FIG. 7, resistors are inserted between the outputs of operational amplifiers ($\mathbf{41}_1$ to $\mathbf{41}_n$) and nodes ($N_1$ to $N_n$) that are contained in the positive grayscale voltage generator 23 and the negative grayscale voltage generator 24. Also, the voltages ($V_1$ to $V_n$) are supplied to the buffer amplifier 41 by the power source supplier 6. In the second embodiment, even in the operational amplifiers ($\mathbf{41}_2$ to $\mathbf{41}_{n-1}$) to determine the middle tone level, the outputs are connected to each other. Also, the buffer amplifier output control signal 40 is sent through the control signal supply terminal 39 to each of the operational amplifiers ($\mathbf{41}_1$ to $\mathbf{41}_n$).

In the second embodiment, the control circuit 5 sends the buffer amplifier output control signal 40 to the predetermined data driver circuit 4 and sends the inverted buffer amplifier output control signal 40 to the other buffer amplifier output control signal 40. The buffer amplifier 41 of the data driver circuit 4 to which the buffer amplifier output control signal 40 is sent sets the output impedance of the operational amplifier at the high impedance, in response to the buffer amplifier output control signal 40. Specifically, among the data driver circuits 4, the bias of at least one grayscale power source operational amplifier is made active and set at the usually operable state. At this time, the buffer amplifier output control signal 40 is sent to the data driver circuit 4 at the inactive state. Since the output of the buffer amplifier 41 of the data driver circuit 4 at the inactive state is set at the high impedance, the abnormal current flow is prevented.

The configuration of the second embodiment is suitable for the driver for driving a large screen LCD. The large screen LCD driver typically has the plurality of control terminals for controlling the grayscale voltage. The fine control corresponding to the property for each LCD panel is carried out by the voltages from the control terminals. In such a case, the outputs of the grayscale power source operational amplifiers are connected to each other so that the displaying trouble referred to as the block irregularity can be prevented.

As mentioned above, the display 1 of the present invention suppresses the occurrence of the displaying discontinuity, even if the different offset voltage exists between the LCD drivers in the grayscale power source operational amplifiers built in the LCD drivers. Further, when the resistors to determine the grayscale voltages in the plurality of LCD drivers are commonly connected, in order to prevent the abnormal current flow caused by the connection between the outputs of the commonly-connected grayscale power source operational amplifiers, the resistor is inserted between the outputs of the grayscale power source operational amplifiers. It is preferred to set the level where the influence of the insertion of the resistors can be neglected and also select the resistance value that enables the current value flowing through the inserted resistor to suppress under an allowable current value.

What is claimed is:

1. A display, comprising:

a display panel having a plurality of data lines; and a plurality of driver units configured to respectively drive ones of the plurality of data lines, wherein each of the plurality of driver units includes:

a resistance division section configured to generate grayscale voltages by dividing a supplied voltage; and an operational amplifier section configured to supply a voltage to terminals of the resistance division section in response to a bias control signal, wherein the terminals of the resistance division section in a driver unit of the plurality of driver units and corresponding terminals of the resistance division section in other driver unit or units are connected to each other, and wherein the bias control signal is supplied to each of the plurality of driver units based on whether the driver unit drives a data line corresponding to the driver unit, and wherein the operational amplifier in each of the plurality of the driver units is selectively either enabled or set at a high impedance state in response to the bias control signal.

2. The display according to claim 1, wherein the grayscale voltages includes positive side grayscale voltages and negative side grayscale voltages, and the resistance division section comprises:

a positive side resistance division section configured to generate the positive side grayscale voltages; and a negative side resistance division section configured to generate the negative side grayscale voltages, and the operational amplifier section includes:

a positive side operational amplifier section connected to the positive side resistance division section; and a negative side operational amplifier section connected to the negative side resistance division section.

3. The display according to claim 2, wherein the positive side operational amplifier includes:

a first positive side operational amplifier configured to supply a higher positive electric potential to the positive side resistance division section; and a second positive side operational amplifier configured to supply a lower positive electric potential to the positive side resistance division section, and the negative side operational amplifier includes:

a first negative side operational amplifier configured to supply a higher negative electric potential to the negative side resistance division section; and a second negative side operational amplifier configured to supply a lower negative electric potential to the negative side resistance division section.

4. The display according to claim 2, wherein the positive side resistance division section includes a plurality of positive side output nodes configured to output the positive side grayscale voltage, the negative side resistance division section includes a plurality of negative side output nodes configured to output the negative side grayscale voltage, the positive side operational amplifier section includes a plurality of positive side operational amplifiers which correspond to the plurality of positive side output nodes respectively, and the negative side operational amplifier section includes a plurality of negative side operational amplifiers which correspond to the plurality of negative side output nodes respectively.

5. The display according to claim 2, further comprising a power source unit configured to supply voltages which are different to each other to a plurality of operational amplifiers included in the operational amplifier section respectively.

6. An LCD driver driving data lines of a display panel, the display panel comprising a plurality of driver units, each of the plurality of driver units including:

a D/A converter configured to convert a digital display data into an analogue data;

an output amplification unit configured to amplify the analogue data outputted from the D/A converter; and a grayscale voltage output unit configured to output grayscale voltages to the D/A converter, wherein the grayscale voltage output unit includes:

an operational amplifier unit; and a grayscale voltage generation unit connected to an output terminal of the operational amplifier unit, and configured to generate the grayscale voltages in response to the signal outputted from the output terminal, wherein the grayscale voltage output unit includes a plurality of output nodes configured to output the grayscale voltages, wherein the plurality of output nodes in an arbitrary driver unit of the plurality of driver units is connected to the plurality of output nodes in another driver unit of the plurality of driver units, and wherein the output terminal of the operational amplifier unit in the arbitrary driver unit is set to be a high impedance when the another driver unit drives corresponding data lines of the plurality of data lines.

7. The LCD driver according to the claim 6, wherein the operational amplifier unit comprises a control terminal configured to receive a control signal, and the operational amplifier unit cuts off a bias current from the output terminal and sets an output to be the high impedance.

8. The LCD driver according to claim 7, wherein the grayscale voltages includes a positive side grayscale voltage and a negative side grayscale voltage, the grayscale voltage generation unit includes:

a first grayscale resistor group configured to generate the positive side grayscale voltage; and a second grayscale resistor group configured to generate the negative side grayscale voltage, the operational amplifier unit includes:

a first operational amplifier connected as a voltage follower which supplies a highest positive potential in the first grayscale resistor group;

a second operational amplifier connected as a voltage follower which supplies a lowest positive potential in the first grayscale resistor group;

a third operational amplifier connected as a voltage follower which supplies a highest negative potential in the second grayscale resistor group;

a fourth operational amplifier connected as a voltage follower which supplies a lowest negative potential in the second grayscale resistor group;

a first resistor connected between an output of the first operational amplifier and a terminal having highest positive potential in the first resistor group;

a second resistor connected between an output of the second operational amplifier and a terminal having lowest positive potential in the first resistor group;

a third resistor connected between an output of the third operational amplifier and a terminal having highest negative potential in the second resistor group; and a fourth resistor connected between an output of the fourth operational amplifier and a terminal having lowest negative potential in the second resistor group, the first operational amplifier includes a first non-inverting input terminal connected to a first power source, the second operational amplifier includes a second non-inverting input terminal connected to a second power source, the third operational amplifier includes a third non-inverting input terminal connected to a third power source, and the fourth operational amplifier includes a fourth non-inverting input terminal connected to a fourth power source.

9. The LCD driver according to claim 8, wherein the first to fourth non-inverting input terminals in a driver unit of the plurality of driver units is respectively connected to the first to fourth non-inverting input terminals in another driver unit of the plurality of driver units, and nodes of the first resistor group and the second resistor group in a driver unit of the plurality of driver units is are respectively connected in parallel to the first resistor group and the second resistor group in another driver unit of the plurality of driver units.

10. A method for driving a display comprising a plurality of driver units, each driver unit driving a block of data lines of the display, the method comprising:

supplying each of the plurality of driver units a bias control signal when a data line for driving a display panel that corresponds to that driver unit is activated, the bias control signal causing an operational amplifier section of that driver unit to leave a high impedance state and enter an operational state, the operational amplifier in each of the plurality of driver units thereby selectively either enabled or set at a high impedance state in response to the bias control signal;

supplying a voltage, from the operational amplifier section of the activated driver unit, to terminals of a resistance division unit configured to generate a grayscale voltage, in response to the bias control signal; and setting an output of amplifiers in the operational amplifier section of a driver unit supplying a voltage to the resistance division unit to be a high impedance when corresponding data lines for that driver unit are inactivated, thereby causing the amplifiers of the operational amplifier section of that driver unit to leave the operational state and return to the high impedance state, wherein the terminals of the resistance division unit of a certain driver unit of the plurality of driver units are commonly connected to terminals of the resistance division unit of other driver units of the plurality of driver units.

11. The display of claim 1, wherein the common connection of the terminals of the resistance division section in all driver units of the plurality of driver units thereby provides same grayscale voltages for all the driver units, thereby substantially eliminating block irregularities between regions of said display panel driven by different driver units.

12. The display of claim 1, wherein the bias control signal is supplied such that an operational amplifier section in only one driver unit of the plurality of driver units is biased to provide grayscale voltages and operational amplifier sections in remaining driver units are biased to be in the high impedance state.

13. The display of claim 12, wherein the plurality of data lines for the display is divided into blocks of data lines, each block of data lines being served by a unique one of the plurality of driver units and the only driver unit having its operational amplifier section biased to provide grayscale voltages belongs to a driver unit currently providing a drive signal to one of the blocks of data lines.

14. The display of claim 1, wherein the high impedance state comprises a default condition for the operational amplifier section, thereby providing a protection for electrical shorts at outputs of operational amplifiers in the operational amplifier section and permitting the terminals of the resistance division sections in the driver units to be interconnected.

15. The LCD driver of claim 6, the common connected terminals of the plurality of driver units thereby providing same grayscale voltages for all the driver units, thereby substantially eliminating block irregularities between regions of said display panel driven by different driver units.

16. The LCD driver of claim 6, wherein a bias control signal is received such that an operational amplifier section in only one driver unit of the plurality of driver units is biased to provide grayscale voltages and operational amplifier sections in remaining driver units are biased to have the high impedance.

17. The LCD driver of claim 16, wherein the plurality of data lines for the display panel is divided into blocks of data lines, each block being served by a unique one of the plurality of LCD drivers and the only LCD driver having its operational amplifier unit biased to provide graysc ale voltages belongs to an LCD driver currently providing a drive signal to one of the blocks of data lines.

18. The method of claim 10, wherein the bias control signal is supplied such that an operational amplifier section in only one driver unit of the plurality of driver units is biased to provide grayscale voltages in the operational state and operational amplifier sections in remaining driver units are biased to be in the high impedance state.

19. The method of claim 18, wherein the plurality of data lines for the display is divided into blocks of data lines, each block of data lines being served by a unique one of the plurality of driver units and the only driver unit having its operational amplifier section biased to provide grayscale voltages in the operational state belongs to a driver unit currently providing a drive signal to one of the blocks of data lines.

20. The method of claim 19, wherein the high impedance state comprises a default condition for the operational amplifier section, thereby providing a protection for electrical shorts at outputs of operational amplifiers in the operational amplifier section and for different offset voltages, thereby further permitting the terminals of the resistance division units in the driver units to be interconnected.

21. The display according to claim 1, wherein:

each of the plurality of driver units further includes a D/A converter configured to convert a digital display data into an analog data based on the gray scale voltages to drive the data line corresponding to the driver unit, and the terminals in each of the plurality of driver units are between the operational amplifier section and the D/A converter.

* * * * *